US009925421B2

(12) United States Patent
Kim

(10) Patent No.: US 9,925,421 B2
(45) Date of Patent: Mar. 27, 2018

(54) GOLF BALL HAVING FORMED THEREIN HIT LINE FOR MAKING FADE SHOT OR DRAW SHOT, AND MANUFACTURING METHOD THEREFOR

(71) Applicant: ACEGOLF CO., LTD., Gwangsan-Gu, Gwangju (KR)

(72) Inventor: Young Jun Kim, Gwangju (KR)

(73) Assignee: ACEGOLF CO., LTD., Gwangsan-Gu, Gwangju (KR)

( * ) Notice: Subject to any disclaimer, the term of this patent is extended or adjusted under 35 U.S.C. 154(b) by 0 days.

(21) Appl. No.: 15/100,263

(22) PCT Filed: Nov. 24, 2014

(86) PCT No.: PCT/KR2014/011296
§ 371 (c)(1),
(2) Date: May 27, 2016

(87) PCT Pub. No.: WO2015/083968
PCT Pub. Date: Jun. 11, 2015

(65) Prior Publication Data

US 2017/0001077 A1 Jan. 5, 2017

(30) Foreign Application Priority Data

Dec. 5, 2013 (KR) ..... 10-2013-0150740

(51) Int. Cl.
*A63B 37/00* (2006.01)
*A63B 69/36* (2006.01)
(Continued)

(52) U.S. Cl.
CPC ..... *A63B 37/0022* (2013.01); *A63B 37/0006* (2013.01); *A63B 37/0074* (2013.01);
(Continued)

(58) Field of Classification Search
CPC ..... A63B 69/3655; A63B 69/3688; A63B 37/0022; A63B 37/14
See application file for complete search history.

(56) References Cited

U.S. PATENT DOCUMENTS 4,706,958 A * 11/1987 Inoue ..... A63B 37/0003 40/327
2003/0109319 A1* 6/2003 Andresen ..... A63B 45/02 473/200
(Continued)

FOREIGN PATENT DOCUMENTS

JP 200/022940 B2 2/2008
KR 200325880 Y1 9/2003
(Continued)

OTHER PUBLICATIONS

International Search Report, dated Mar. 6, 2015, from corresponding International Application No. PCT/KR2014/011296.

*Primary Examiner* — John E Simms, Jr.
(74) *Attorney, Agent, or Firm* — Wolf, Greenfield & Sacks, P.C.

(57) ABSTRACT

A golf ball having formed therein a hit line for making a fade shot or a draw shot, and a manufacturing method therefor and, more specifically, to a golf ball having formed therein a hit line for making a fade shot or a draw shot, and a manufacturing method therefor, the golf ball having a balance line, a fade line, and a draw line formed on the outer surface of the golf ball to thus unify a golfer's intended direction and the flying direction of the golf ball if a driving shot or a putting shot is made, thereby enabling putting with a precise hit and enabling a fade shot or a draw shot to be more effectively made. The present invention relates to a golf ball having a plurality of dimples and a bonding line formed on the outer peripheral surface thereof, wherein: a gravity center indication point for indicating the center of gravity of the golf ball is formed on the outer surface of the
(Continued)

golf ball; a balance line passing through the gravity center indication point is formed; and a fade line for guiding a fade shot and a draw line for guiding a draw shot are formed on both sides on the basis of the balance line in a state of being spaced apart from each other at regular intervals.

5 Claims, 2 Drawing Sheets

(51) Int. Cl.
*A63B 37/14* (2006.01)
*A63B 71/06* (2006.01)

(52) U.S. Cl.
CPC ..... *A63B 37/14* (2013.01); *A63B 69/3655* (2013.01); *A63B 69/3688* (2013.01); *A63B 71/06* (2013.01); *A63B 2071/0694* (2013.01)

(56) References Cited

U.S. PATENT DOCUMENTS

| | | | | |
|---|---|---|---|---|
| 2007/0207874 | A1* | 9/2007 | Klein ..... | A63B 69/3655 473/280 |
| 2008/0020865 | A1* | 1/2008 | Mitsuba ..... | A63B 37/0003 473/378 |
| 2008/0271334 | A1* | 11/2008 | Sung ..... | A63B 45/02 33/562 |

FOREIGN PATENT DOCUMENTS

| | | | |
|---|---|---|---|
| KR | 1020040060911 | A | 5/2004 |
| KR | 2020090007437 | U | 6/2012 |

* cited by examiner

[Fig. 1]
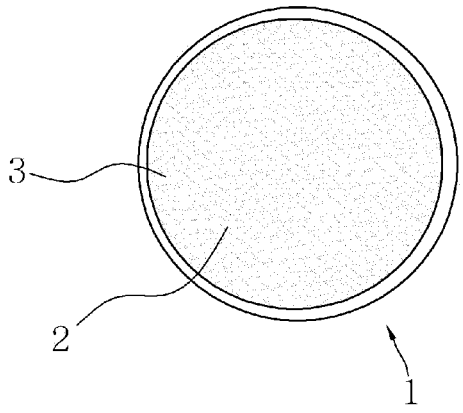
[Fig. 2]
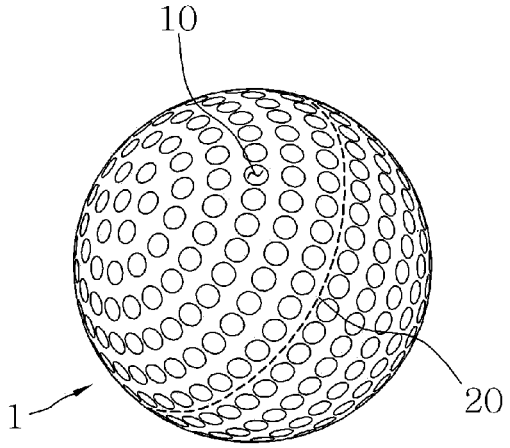
[Fig. 3]
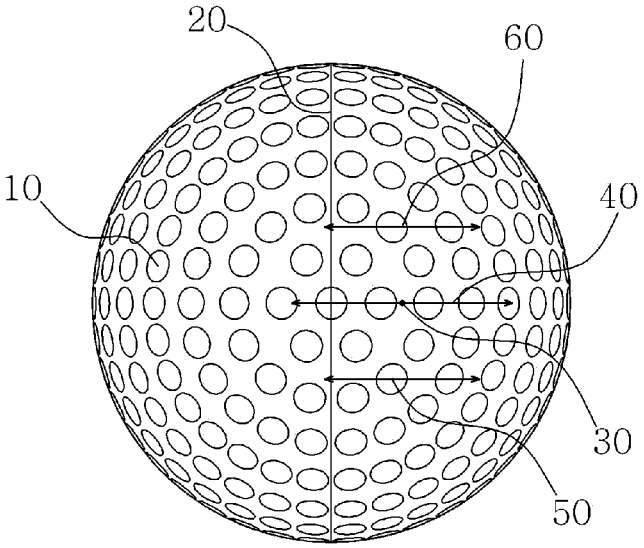

[Fig. 4]
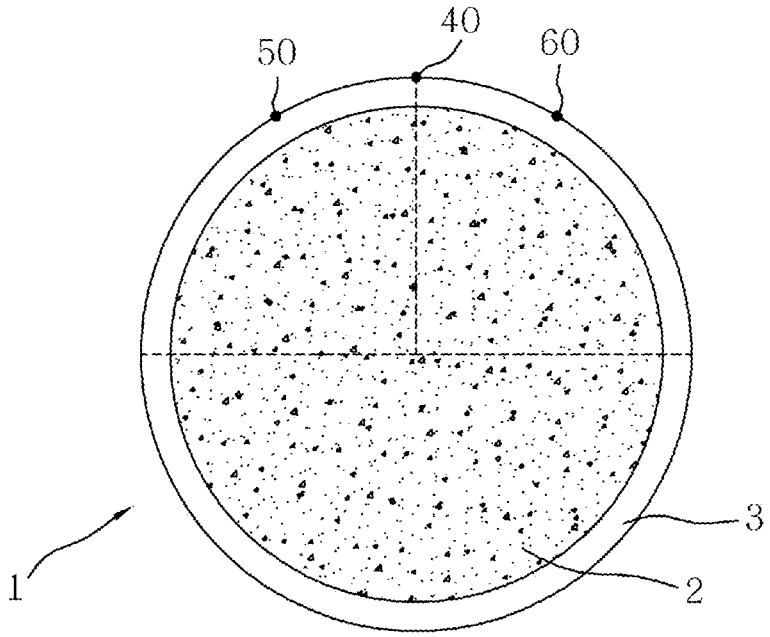
[Fig. 5]
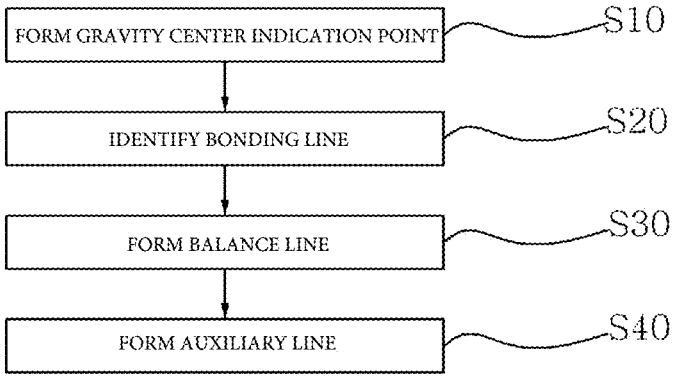

GOLF BALL HAVING FORMED THEREIN HIT LINE FOR MAKING FADE SHOT OR DRAW SHOT, AND MANUFACTURING METHOD THEREFOR

CROSS-REFERENCE TO RELATED APPLICATIONS

This application is the national phase of International Application No. PCT/KR2014/011296, filed on Nov. 24, 2014, which claims the priority benefit of Korean Patent Application No. 10-2013-0150740, filed with the Korean Intellectual Property Office on Dec. 5, 2013, which applications are hereby incorporated by reference to the maximum extent allowable by law.

TECHNICAL FIELD

The present invention relates to a golf ball provided with hitting lines for making a fade shot and a draw shot and a method of manufacturing the same, and more particularly, to a golf ball provided with hitting lines for making fade and draw shots, on which balance, fade, and draw lines are formed on an outer surface of the golf ball so that a travel direction of the golf ball matches a direction desired by a golfer to effectively make the fade and draw shots in addition to putting by an accurate hitting when a driving or putting shot is made, and a method of manufacturing the same.

BACKGROUND ART

Generally, when a driver shot or iron shot is made in golf, a posture of a player and a hitting point on a golf ball are important for securing a desired driving distance and direction of the golf ball. Particularly, the golf ball can travel a large distance only by hitting a portion of a golf ball spaced a predetermined distance from the center of the golf ball downward such that the golf ball rotates backward and a lift force occurs in a direction perpendicular to a travel direction of the golf ball. When this principle is particularly applied to golf, in order to send a golf ball flying far away in a desired direction, accurately checking the center of gravity of the golf ball to hit the golf ball is recognized as being important to players.

Here, the golf ball to be used in golf games is manufactured with a diameter greater than 1.68 inches (42.67 mm) and a weight less than 1.62 ounces (45.93 g). As shown in FIG. 1, generally, the golf ball includes a core (2) formed at the center and a cover (3) which surrounds the core (2).

However, since mass-produced golf balls have centers of gravity different from each other and may also have weights different from each other, it is very difficult to find the center of gravity of each golf ball and to set an upper point of the center of gravity as an axis of rotation.

That is, since a core of a golf ball is heavier than a cover thereof, when the core is not positioned at the center of the golf ball and is biased to one side, a heavy side and a light side are generated in the golf ball necessarily causing the golf ball to be unbalanced, and thus, a trajectory of the golf ball has to bend in a direction of the heavy side because a weight distribution of left and right sides is non-uniform when the golf ball spins.

Accordingly, recently, a golf ball is used with a putting line arbitrarily marked on an outer circumferential surface thereof. However, the putting line causes a problem in that the golf ball is hit inaccurately due to the low accuracy of the line.

TECHNICAL PROBLEM

The present invention is directed to providing a golf ball provided with hitting lines for making fade and draw shots, on which a balance line is formed on an arbitrary line for which a gravity center indication point of the golf ball is perpendicular to a bonding line of the golf ball so that a direction desired by a golfer matches a travel direction of the golf ball for putting the golf ball by accurate hitting and fade and draw lines are also formed on both sides of the balance line for making more effective fade and draw shots when a driving or putting shot is made, and a method of manufacturing the same.

TECHNICAL SOLUTION

One aspect of the present invention provides a golf ball provided with hitting lines for performing a fade shot and a draw shot, the golf ball including a plurality of dimples and a bonding line formed on an outer circumferential surface thereof, wherein a gravity center indication point for indicating the center of gravity of the golf ball is formed on an outer surface of the golf ball, a balance line passing through the gravity center indication point is formed thereon, and a fade line which guides the fade shot and a draw line which guides the draw shot are spaced apart by a constant distance and formed on both sides of the balance line.

In addition, the gravity center indication point may be formed to be positioned at the center of the balance line, and the balance line may pass through the gravity center indication point and be formed on an arbitrary line perpendicular to the bonding line.

Further, the fade line or the draw line may be spaced a constant distance from the balance line and formed on both sides of the balance line positioned at an uppermost point in a cross-sectional view of the golf ball, be formed on both sides at an angle in the range of 1° to 90° from the balance line 40, and be formed on both sides of the balance line to be parallel to the balance line.

DESCRIPTION OF DRAWINGS

FIG. 1 is a view illustrating the inside of a typical golf ball.

FIG. 2 is a view illustrating a bonding line formed on an outer circumferential surface of the typical golf ball.

FIG. 3 is a view illustrating a golf ball according to an embodiment of the present invention.

FIG. 4 is a cross-sectional view of the golf ball for describing positions on the golf ball at which a fade line and a draw line are formed according to the embodiment of the present invention.

FIG. 5 is a flowchart for describing a method of manufacturing the golf ball according to the embodiment of the present invention.

MODES OF THE INVENTION

Hereinafter, a golf ball provided with hitting lines for making a fade shot and a draw shot according to the present invention and a method of manufacturing the same will be described in detail with reference to the accompanying drawings. In the description of the present invention, when determined that a detailed description of the related art or a configuration of the present invention unnecessarily obscures the gist of the present invention, the detailed description will be omitted.

In addition, as the terms to be described below are the terms set in consideration of functions of the present invention, the terms may vary according to an intention of producers or manufacturers by which products are manufactured. In the drawings, the thicknesses of lines and sizes of components may be exaggerated with respect to actual physical thicknesses and sizes for convenience of description. Since the embodiments and drawings of the present invention are merely exemplary embodiments and drawings and do not fully cover the technical sprit of the present invention, it should be understood that the present invention is to cover all modifications, equivalents, and alternatives falling within the spirit and scope of the present invention.

First, resistance generated from a fast flying golf ball includes frictional resistance generated at a front surface of the golf ball and form resistance generated at the rear thereof. The frictional resistance is resistance generated at the golf ball due to friction between air and the golf ball, and the form resistance is resistance generated by a vortex of air generated at the rear of the golf ball when the golf ball flies in the air.

Of the above resistance, the form resistance acts as a major factor for degrading the properties of a trajectory and a driving distance of the golf ball, and thus, a plurality of concave grooves, i.e., referred to as dimples 10, are formed on an outer surface of the golf ball to reduce the form resistance.

Since a flow of air is relatively slow with respect to a golf ball having the dimples 10 when compared with a golf ball having no dimples, a vortex generated at the rear of the golf ball, i.e., a wake generation region, is reduced, and thus, form resistance generated when the wake pulls the golf ball in a direction opposite a flying direction is decreased.

When dimples are arranged on a surface of the golf ball, the dimples are designed using various polyhedrons made by dividing a surface of a sphere into a plurality of circles. For example, there are many types of divided compositions of the sphere such as a spherical tetrahedron having four spherical triangles, a spherical hexahedron having six spherical quadrangles, a spherical octahedron having eight spherical triangles, a spherical dodecahedron having 12 spherical pentagons, a spherical icosahedron having 20 spherical triangles, etc.

Further, the dimples are arranged by additionally subdividing the above spherical polyhedrons to classify the surface of the sphere into a spherical 20-12 polyhedron, a spherical 6-8 polyhedron, etc. However, although all of the divided compositions are divided into spherical polyhedrons different from each other to arrange the dimples, the divided compositions may still overlap each other in spheres having the same diameter.

Nevertheless, the reality is that a golf ball having dimples arranged by a yet new divided composition is manufactured. The reason is that the size, depth, shape of each dimple may vary because the sizes of surface areas of faces of the polyhedron may vary according to the type of divided composition when the dimples are arranged on an entire surface of a sphere.

As a result, new divided compositions are continually being made because a flight characteristic varies according to arrangement of each dimple. Further, when dimples are arranged on a surface of a sphere using the above division method of the spherical polyhedron, the dimples arranged symmetrically with respect to each other within one face of the polyhedron make an excellent flight characteristic when compared with an asymmetrical arrangement thereof even in the same polyhedron.

While the golf ball flies, since the resistance of air is a bit more uniform in a low speed region from a peak of a trajectory to the ground where a golf ball drops, wobbling of the golf ball is reduced, and thus, the golf ball lands with a stable arcing trajectory.

Pressure drag affects a large dimple more than a small dimple in a flying region from a point where the golf ball is hit to the peak of the trajectory, i.e., a high speed region, whereas the pressure drag affects the large dimple less than a small dimple in the low speed region.

Accordingly, a new method of dividing a surface of a golf ball sphere and an arrangement of dimples on the surface of the divided sphere are important factors in order for the golf ball to have a more uniform landing property and an excellent driving-distance property.

Further, although an upper portion and a lower portion of a golf ball have been formed identically by forming the golf ball having the dimples on an outer surface by joining an upper mold and a lower mold in a manufacturing process for the golf ball, the dimples are arranged without regular criteria or rules. In addition, a setup of the rules is difficult to arrange about 500 dimples within a diameter of 42.67 mm.

Accordingly, recently, various studies on arrangement, numbers, various sizes, volumes, and forms have been conducted to further increase a driving distance of a golf ball and to further improve the aerodynamic symmetry of the golf ball.

Specifically, during putting the golf ball, the degree of arcing of a golf ball having dimples asymmetrically arranged with respect to a bonding line (The golf ball is manufactured by manufacturing a core and pressing half covers from both directions. Thus, when the golf ball is checked carefully, a bonding line due to joining of the half covers is faintly visible.) is greater than that of a golf ball having dimples symmetrically arranged, and the reason is a bonding line 20 in a ring shape formed at a position where joining molds of a golf ball are separated from each other. In a conventional art, modifications have been applied to dimples near the bonding line 20 in the ring shape to improve a rotation performance of the golf ball.

In addition to the arrangement of the dimples for rotation of the golf ball, a uniform weight distribution of left and right sides of a golf ball with respect to a rotation line and a bonding line 20 positioned at the same line as a line connecting the left and right sides with respect to the rotation line are very important factors for a spinning golf ball.

Accordingly, in the embodiment of the present invention, as shown in FIGS. 3 and 4, the center of gravity of the golf ball is found, a gravity center indication point 30 for indicating the center of gravity thereof is formed on an outer surface of the golf ball, a balance line 40 passing through the gravity center indication point 30 is formed, and a fade line 50 and a draw line 60 spaced apart by a constant distance and formed on both sides of the balance line 40 and respectively guide a fade shot and a draw shot are formed.

That is, the balance line 40 is formed to pass through the gravity center indication point 30, the fade line 50 is formed on one side of the balance line 40 to guide a fade shot, and the draw line 60 is formed on the other side of the balance line 40 to be symmetrical with the fade line 50.

At this point, the draw line 60 and the fade line 50 are formed to be spaced a constant distance from the balance line 40 to be parallel to the balance line 40.

Further, when the balance line 40 is formed, it may be preferable that the gravity center indication point 30 be positioned at the center of the balance line 40, the balance line 40 pass through the gravity center indication point 30, and the balance line 40 be formed on an arbitrary line perpendicular to the bonding line 20.

As described above, since the gravity center indication point is positioned at the center of the balance line and the balance line is formed perpendicular to the bonding line 20, a direction desired by a golfer matches a travel direction of a golf ball when the golf ball is hit, and thus, a straight directivity by rotation and a driving distance can be secured more effectively.

In addition, in the case of an example of a golf ball hit using the fade line 50 and the draw line 60 when the fade line 50 is formed on a left side based on the balance line 40 and the draw line 60 is formed on a right side based on the balance line 40, when a fade shot needs to be made due to a front obstacle, the golf ball is hit while the fade line 50 is positioned at an uppermost side, then a trajectory of the golf ball is bent in a right side where the center of gravity is located and the golf ball flies to avoid the front obstacle, and thus, the golf ball can avoid the front obstacle.

Since the center of gravity of the golf ball is positioned at a right side more than the fade line 50, when the golf ball is hit, the trajectory of the golf ball is bent in a direction of the center of gravity and the golf ball flies.

At this point, in order to further improve the result of the fade shot, when a golfer hits a golf ball like cutting and sliding the golf ball, more spin is generated for the golf ball and the golf ball may be dropped at a position further to the right than expected.

In addition, as the draw line 60 is for bending a trajectory of a golf ball to the left direction while the golf flies, the draw line 60 is formed on a right side of the balance line 40.

That is, in the case of the draw shot due to a front obstacle for bending a trajectory of a golf ball to the left while the golf flies, the golf ball is hit while the draw line 60 is positioned at an uppermost side as in the description of the fade line 50, then the golf ball flies and a trajectory thereof is bent to the left, and thus, the golf ball can avoid the front obstacle.

As in the above description, since the center of gravity of the golf ball is positioned at more to the left of the draw line 60, when the golf ball is hit, the golf ball flies and a trajectory thereof is bent to the left where the center of gravity is located.

Further, as shown in FIG. 4, the fade line 50 and the draw line 60 are spaced apart by a constant distance and formed on both sides of the balance line 40 positioned at an uppermost point in a cross-sectional view of the golf ball 1 and are formed on left and right sides at an angle in the range of 1° to 90° from the balance line 40.

Here, with the above angle increasing, the amount of bending of the golf ball trajectory increases, and thus, a more effective fade or draw shot can be made.

Meanwhile, as shown in FIG. 5, a method of manufacturing the golf ball according to the embodiment of the present invention includes forming a gravity center indication point (S10), identifying a bonding line (S20), forming a balance line (S30), and forming auxiliary lines (S40).

The forming of the gravity center indication point (S10) includes forming the gravity center indication point which indicates the center of gravity of a golf ball on an outer surface of the golf ball. At this point, before forming the gravity center indication point 30 on the outer surface of the golf ball, the center of gravity of each golf ball has to be found first.

After finding the center of gravity of the golf ball and forming the gravity center indication point 30 on the outer surface of the golf ball, the bonding line 20 generated in a process of manufacturing the golf ball is identified.

That is, the golf ball is manufactured by manufacturing a spherical core 2 and a cover 3. The cover 3 is divided into two half covers, the half covers are pressed from both directions to surround the core 2, and at this point, the bonding line 20 is a line generated when the hemispherical covers are bonded.

After the bonding line is identified from the golf ball, the balance line 40 is formed by the forming of the balance line (S30).

That is, the balance line 40 is formed on an arbitrary line for which the gravity center indication point 30 is perpendicular to the bonding line 20, wherein it may be preferable that the gravity center indication point 30 be formed to be positioned at the center of the balance line 40.

As described above, since the balance line 40 is formed perpendicular to the bonding line 20, a travel direction of the golf ball desired by a golfer is disposed to match the balance line 40 when the golf ball is hit. Thus, the golf ball rotates along the balance line 40 when airborne or rolling, thereby contributing to accurate putting and improved driving distance.

When the balance line 40 is formed on the golf ball, the fade line 50 and the draw line 60 are formed on both sides of the balance line 40 by the forming of the auxiliary lines (S40). That is, the fade line 50 and the draw line 60 are spaced apart by a constant distance and formed on both sides of the balance line 40 to be parallel to the balance line 40.

Here, it may be preferable that the fade line 50 and the draw line 60 be formed on left and right sides at an angle in the range of 1° to 90° from the balance line 40.

Here, when the fade or draw shot is performed using a golf ball in which the fade line 50 and draw line 60 are formed at an angle over 90° from the balance line 40, an effective result cannot be expected, and thus, the fade line 50 or the draw line 60 has to be formed within 90° from the balance line 40.

The above description exemplarily describes the present invention and one skilled in the art may understand that the present invention can be variously modified into, changed to, and replaced with another concrete form without changing the essential features of the present invention. Therefore, the embodiments and accompanying drawings disclosed herein are for the purpose of describing the technical sprit of the present invention only and the scope of the technical sprit is not intended to be limited by the embodiments and accompanying drawings. The scope of the present invention is interpreted according to the scope of the appended claims, and all technical concepts equivalent to the foregoing are interpreted to be included within the scope of the present invention.

INDUSTRIAL APPLICABILITY

According to the embodiment of the present invention, a balance line is formed on an arbitrary line for which a gravity center indication point of the golf ball is perpendicular to a bonding line of the golf ball so that a direction desired by a golfer matches a travel direction of the golf ball, thereby effectively securing a straight trajectory by rotation and a driving distance, and in addition, effective fade and draw shots can be made due to fade and draw lines formed on both sides of the balance line.

The invention claimed is:

1. A golf ball provided with hitting lines for making a fade shot and a draw shot, the golf ball comprising a plurality of dimples and a bonding line formed on an outer circumferential surface thereof, wherein a gravity center indication point for indicating the center of gravity of the golf ball is formed on an outer surface of the golf ball, a balance line passing through the gravity center indication point is formed thereon, and a fade line which guides the fade shot and a draw line which guides the draw shot are spaced apart by a constant distance and formed on both sides of the balance line, wherein the balance line passes through the gravity center indication point and is perpendicular to the bonding line.

2. The golf ball of claim 1, wherein the gravity center indication point is formed to be positioned at the center of the balance line.

3. The golf ball of claim 1, wherein the fade line and the draw line are spaced a constant distance from the balance line and formed on both sides of the balance line at an angle in the range of 1° to 90° from the balance line along an outer circumferential surface of the golf ball.

4. The golf ball of claim 1, wherein the fade line and the draw line are formed on both sides of the balance line to be parallel to the balance line.

5. A method of manufacturing a golf ball provided with hitting guidelines, the method comprising:

forming a gravity center indication point to form a gravity center indication point which indicates the center of gravity of the golf ball on an outer surface of the golf ball;

identifying a bonding line to identify a bonding line of the golf ball on which two hemispheres of the golf ball are bonded;

forming a balance line, perpendicular to the bonding line and connected to the gravity center indication point, which guides a driver shot or putting shot; and forming auxiliary lines to form a fade line and a draw line which are spaced apart by a constant distance and formed on both sides of the balance line to be parallel to the balance line.

* * * * *